US005240158A

United States Patent [19]

Walsh

[11] Patent Number: 5,240,158

[45] Date of Patent: Aug. 31, 1993

[54] BELT-TYPE CARRIER DEVICE

[75] Inventor: Thomas Walsh, Wildwood, N.J.

[73] Assignee: Casino Promotions, Inc., N. Wildwood, N.J.

[21] Appl. No.: 836,724

[22] Filed: Feb. 19, 1992

[51] Int. Cl.[5] ..... A45F 3/00; A45F 5/00

[52] U.S. Cl. ..... 224/226; 224/148; 224/223; 224/253; 224/250

[58] Field of Search ..... 224/148, 253, 224, 151, 224/223, 242, 250, 226

[56] References Cited

U.S. PATENT DOCUMENTS

| | | | |
|---|---|---|---|
| 1,421,451 | 7/1922 | Garberding | 224/223 |
| 1,530,342 | 3/1925 | Barber | 224/224 |
| 1,617,600 | 2/1927 | Kirsch | 224/223 |
| 1,703,138 | 2/1929 | Falcone et al. | 224/223 |
| 4,337,883 | 7/1982 | Pate | 224/253 |
| 4,420,104 | 12/1983 | DiIenno | 224/253 |
| 4,498,615 | 2/1985 | Johnson | 224/901 |
| 4,751,923 | 6/1988 | Marino | 224/901 |
| 5,060,835 | 10/1991 | Payne | 224/224 |

FOREIGN PATENT DOCUMENTS

| | | | |
|---|---|---|---|
| 337976 | 7/1919 | Fed. Rep. of Germany | 224/223 |

*Primary Examiner*—Linda J. Sholl

*Attorney, Agent, or Firm*—Norman E. Lehrer

[57] ABSTRACT

An article of wearing apparel is provided which includes a belt having a carrying support assembly mounted thereon for carrying and supporting separable articles such as containers of the same or different sizes that are used to carry a plurality of coins or other small objects and/or liquids and thus free the hands of the user for other activities. The carrying support assembly includes an elongated strap which is mounted on the belt at its opposing ends in alignment with the longitudinal axis of the belt and the portion of the belt between the ends mounted on the belt being readily adjustable by a wearer for encircling the containers of different sizes and suitable supporting them on the belt.

7 Claims, 2 Drawing Sheets

BELT-TYPE CARRIER DEVICE

FIELD OF THE INVENTION

The present invention relates to wearing apparel, and more particularly to wearing apparel such as belts which provide a suitable carrying support for a variety of separable containers, including liquid containing containers.

BACKGROUND OF THE INVENTION

There have been numerous devices suggested for carrying and/or supporting different articles on wearing apparel and the like, such as belts, which assist in freeing the users' hands for performing other activities in different environments. Such known devices are, in general, provided with a variety of different attachment means such as, for example, clips and the like integral with the articles or with cases configured therefor; specially configured holders and attachment means for the wearing apparel and/or articles to be carried, such as hooks, spring clamps and the like, all of which generally limit the type and number of articles that may be carried and the wearing apparel for which they may be suitable. It would, thus, be desirable if an item of wearing apparel such as a belt was provided which could be readily used as a carrying support suitable for one or more of a variety of different separable articles such as containers of different sizes and configurations, particularly containers suitable for carrying a plurality of coins and other small objects and/or liquids.

SUMMARY OF THE INVENTION

It is an object of the present invention to provide an article of wearing apparel such as a belt which includes carrying support means suitable for one or more separable articles such as containers for a plurality of small articles and/or liquids, wherein the carrying device is readily adjustable by the user for supporting separable articles of different sizes and, thus, free the hands of the user for other activities.

It is another object of the invention to provide an article of clothing or wearing apparel such as a belt having more than one carrying support device mounted thereon which is readily adaptable for concurrently suitably supporting different size separable containers such as cups, cans, and the like for carrying liquids or a plurality of small items such as coins.

It is a further object of the present invention to provide a belt for an individual having at least two carrying support devices releasably mounted thereon which are each readily adjustable by the wearer during use for concurrently suitably supporting the same or different size separable containers and the like for carrying a plurality of small objects such as coins and/or liquids so as to free the hands of the user for different activities.

It is a still further object of the present invention to provide a belt having carrying support devices releasably mounted thereon which are readily manually adjustable for concurrently suitably supporting at least two of the same or different size separable containers such as cans, cups and the like for safely carrying a plurality of coins, other small objects and/or liquids so as to free the hands of the user for other activities.

In accordance with the present invention there is provided an article of wearing apparel suitable for use in carrying and supporting at least one separable article which comprises:

belt means having means for securing the same about an individual and having mounted thereon at least one carrying support means, said carrying support means being adjustable to suitably support on said belt means articles of different sizes.

In another aspect of the present invention there is provided an article of wearing apparel suitable for carrying thereon separable container-like articles of the same or different sizes which comprises;

belt means having means for securing the same about an individual; and carrying support means having mounting means for mounting the same on said belt means and manual adjusting means for suitably supporting separable container-like article of different sizes on said belt means, wherein the hands of the user would be free to perform other activities.

Other objects, features and advantages will be readily apparent from the following detailed description of preferred embodiments thereof taken in conjunction with the drawing.

BRIEF DESCRIPTION OF THE DRAWINGS

For the purpose of illustrating the invention, there are shown in the accompanying drawings embodiments which are presently preferred; it being understood that the invention is not intended to be limited to the precise arrangements and instrumentalities shown.

DESCRIPTION OF THE PREFERRED EMBODIMENTS

Figure 1:
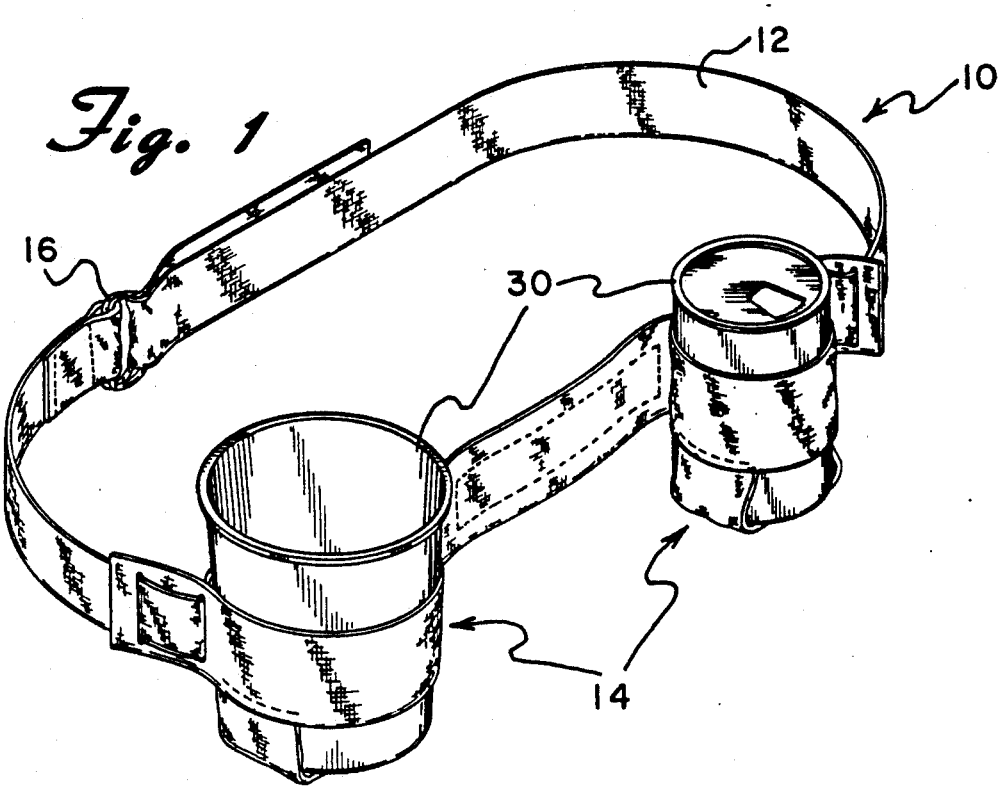
FIG. 1 is a front perspective view of a belt-type carrier device embodying the principles of the present invention shown with the ends fastened and supporting two different containers thereon.
Figure 2:
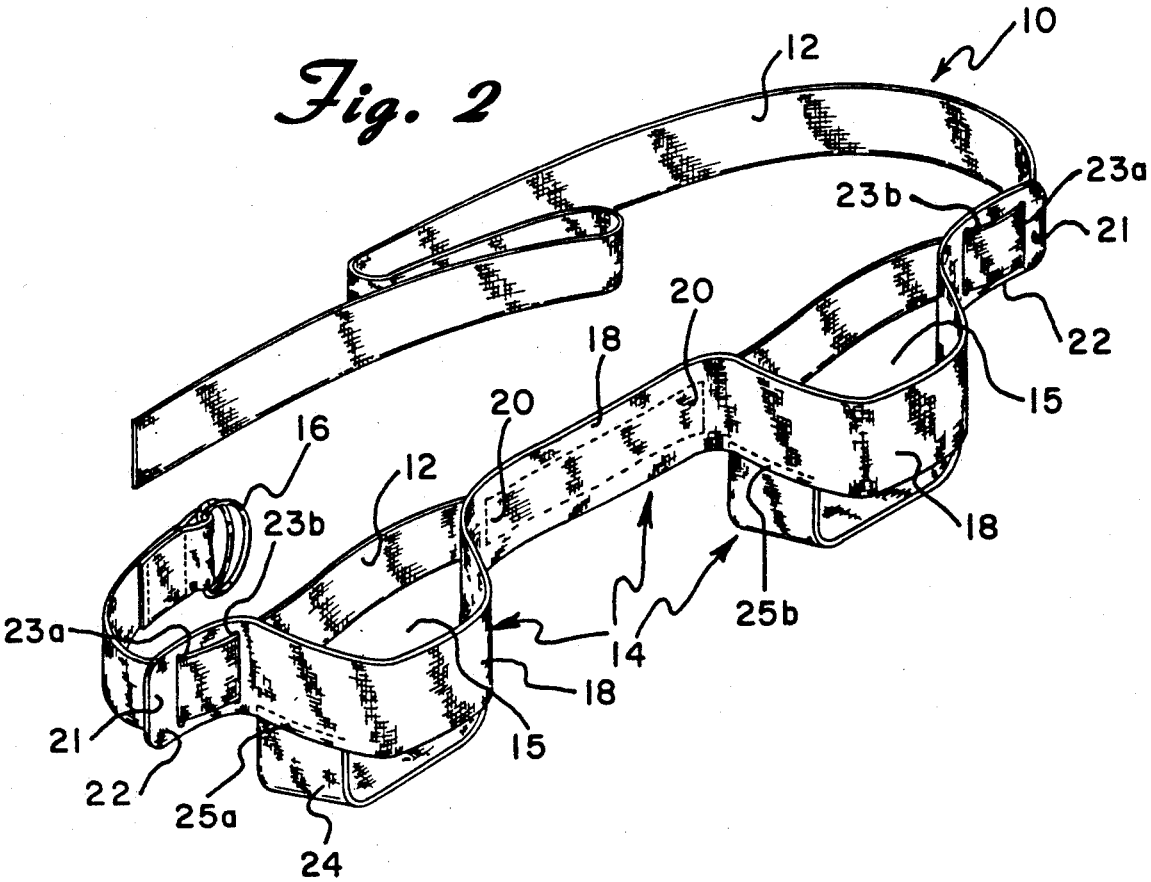
FIG. 2 is a front perspective view of a belt-type carrier device embodying the principles of the present invention with the ends thereof unfastened.
Figure 3:
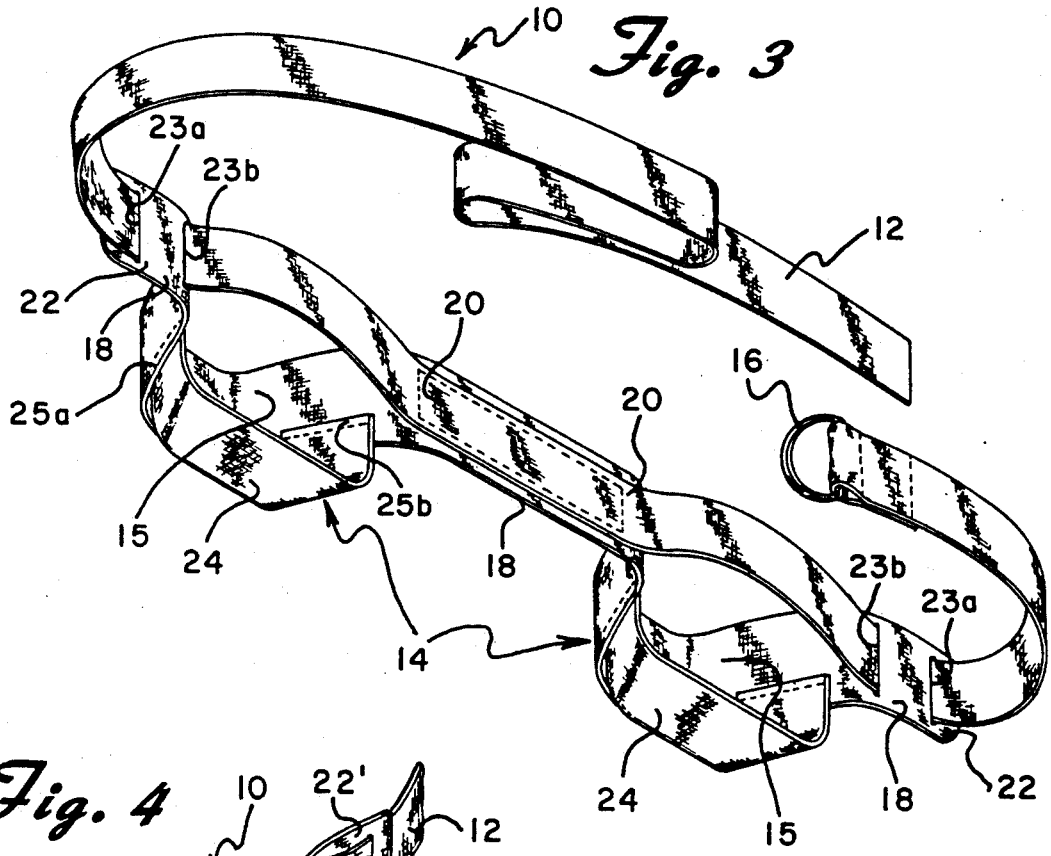
FIG. 3 is a bottom perspective view of the belt of FIG. 2.

Referring now to the drawing, where like reference numerals identify like parts, there is illustrated in FIGS. 1 to 3, a belt-type carrier device in accordance with the invention shown generally as 10, which includes a belt 12 with a carrier support assembly 14 mounted thereon and a fastening buckle 16 secured on one end of the belt 12.

Belt 12 is an elongated wide strip (1¼" to 2" wide) of flexible fabric material which is intended to encircle a person's waist having a belt buckle 16 of conventional configuration for securing the belt in place on the user. Belt 12 is a flexible web-like natural or synthetic fabric material of more or less conventional belt or the like construction and configuration. The web-like material from which the belt is fabricated is flexible and tear resistant, providing for the installation thereof about an individuals waist with ease while affording the strength and tear resistance to carry a plurality of articles thereon and withstand physical abuse during use in various environments. Preferably, the web-like fabric material has a relatively rough, high-friction surface sufficient to engage portions of the surface of the carrier support assembly and assist in sustaining any adjustments thereto for supporting different types and sizes of containers and the like thereon. It would be evident that the belt may be fabricated from other conventional materials such as leather and the like having essentially the same or similar features as the woven fabric, and other means for securing the ends of the belt about the waist of a user may be used including, for example, VELCRO attachment material.

The carrier support assembly 14 is fabricated from a first elongated wide strap of flexible fabric material 18 and one or more second straps of flexible fabric material 24, straps 18 and 24 being of generally the same web-like fabric construction as that used for the belt 12. The web-like fabric strap 18 is approximately ½" wider than belt 12 and when superimposed over a portion of the outer front surface of the belt 12, the opposite longitudinal edges thereof extend beyond the opposite longitudinal edges of the belt 12. The central portion of strap 18 is fixedly secured to the belt 12 by sewing or the like. Two spaced parallel slots 23*a*, 23*b* are formed in each of the free ends 22 of the strap 18 transverse to the longitudinal axis of the strap 18 of sufficient length to enable the belt 12 to be threaded therethrough by virtue of which, ends 22 of the strap 18 are slidably mounted about the belt 12. Each portion of the strap 18 between the secured ends 20 and the free ends 22 thus forms a loop with the outer face of the contiguous belt 12 which is readily adjustable in diameter to engage the outer surface of containers 30 such as cups, cans and the like articles to be supported thereby. Second strap of flexible material 24 extends between legs of the loop formed by the first strap 18 and is secured to the opposed bottom edges 25*a*, 25*b* of the first strap 18, thus providing the carrier support assembly 14 with generally pocket-like members 15 having an adjustable encircling strap and bottom end which affords enhanced adjustable support for containers and the like.

In the embodiment shown in FIGS. 1 to 3, strap 18 is of a length sufficient to form a carrier support assembly 14 with two generally pocket-like members 15, wherein a short portion of the flexible strap material 18 is fixedly secured to the belt 12 intermediate the ends thereof and the opposite free ends 22 of the carrier support assembly 14 are slidably mounted on belt 12. Thus, there are provided two pocket-like members 15 having loops contiguous with belt 12, each of which can be separately adjusted when desired, for example, by a wearer grasping a lip 21 of an end 22 to draw the strap 18 and closely encircle a container to be carried thereby and support the same on the belt. As shown in FIG. 1, two different containers 30 are mounted on the belt 12 with suitable support for each container 30 being achieved by manual adjustment of straps 18 as required by a wearer of the belt. It would be evident that a carrier support assembly 14 having only one pocket-like member 15 could be fabricated with one secured end 20 and one slidably adjustable end 22; or more than one such carrier support assembly 14 or combinations thereof could be mounted on a belt as desired.

Figure 4:
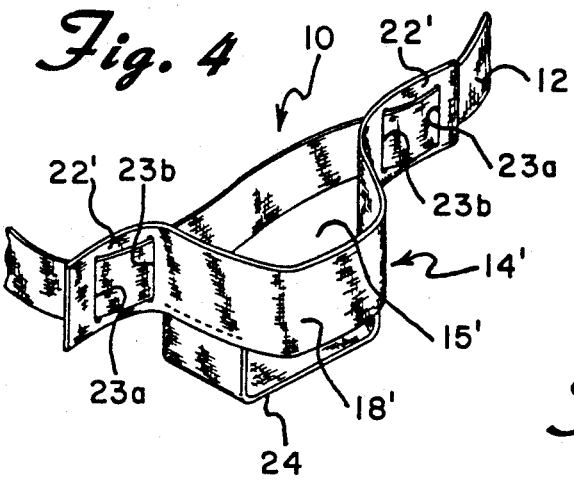
FIG. 4 is a rear perspective view, part of the belt broken away, of an alternative embodiment of a belt-type carrier device embodying the principles of the present invention.
Figure 5:
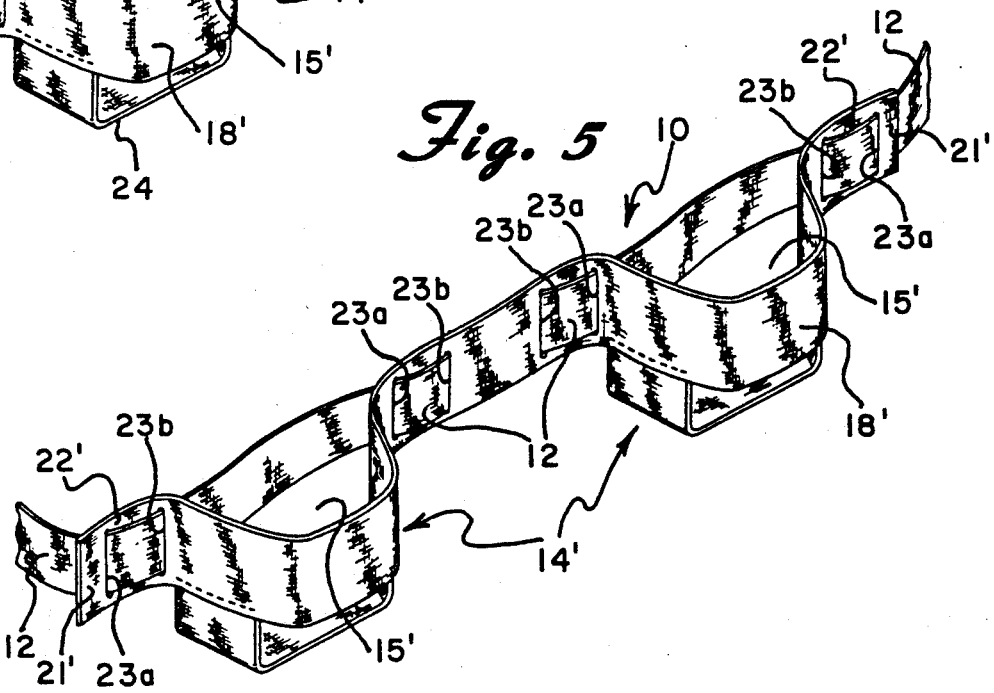
FIG. 5 is a perspective view of one of the carrier support members of FIG. 4, with part of the belt broken away.

Referring now to the embodiments illustrated in FIGS. 4 and 5, there is shown in FIG. 5 an alternative embodiment of the invention wherein a belt 12 having a carrier support assembly 14' with two pocket-like members 15' mounted thereon and no portion of the length of the first flexible strap 18' is fixedly secured to the belt 12. In this embodiment, two spaced pairs of spaced parallel slots 23*a*, 23*b* transverse to the longitudinal axis of the belt 18' are formed in a central portion of the strap 18' through which the belt 12 may be threaded and each of the opposite free ends 22' of said strap 18' are similarly provided with a pair of spaced parallel slots through which the belt 12 is threaded with the ends 22' being slidably mounted thereon. The carrier support assembly 14' thus includes two pocket-like members 15' wherein the position of the carrier support assembly can be positioned on the belt 12 as desired and each pocket-like member 15' thereof can be readily separately adjusted, as indicated, by the user for containers of different sizes.

The embodiment illustrated in FIG. 4 shows a belt 12 wherein a carrier support assembly 14' with one pocket-like member 15' is mounted thereon employing a flexible strap 18' which is slidably mounted about the belt. It would be evident that a belt with a plurality of such carrier support assemblies 14' could be readily assembled if desired.

From the foregoing it will be apparent that the belt-like carrier device of the invention constitutes a departure from the prior art concepts of wearing apparel providing carrying support means for articles, being design for providing suitable support for carrying a plurality of articles of different sizes including containers for carrying coins and similar small objects and/or liquids which would permit the hand of the user to be used for other activities.

Having thus described the invention in relation to the drawings hereof, it will be clear that modifications could be made in the preferred embodiments without departing from the spirit of the invention. Accordingly, it is not intended that the words used to describe the invention be limiting thereof nor should the drawings be considered so. It is intended that the invention be limited only by the appended claims.

What is claimed is:

1. An article of wearing apparel suitable for use in carrying and supporting at least one separable article which comprises belt means having means for securing the same about an individual and having mounted thereon at least one carrying support means, said carrying support means being secured at one end to said belt means and having a free end slidably mounted about said belt means which is adjustable to suitably support and engage the periphery of separable articles of different sizes to be carried on said belt means, said carrying support means further comprising bottom support means for providing additional support to the bottom of said articles.

2. The article of wearing apparel according to claim 1, wherein said carrying support means includes strap means mounted on said belt means having a free end which is slidably adjustable relative to said belt means to closely encircle and support separable articles on said belt means.

3. The article of wearing apparel according to claim 1, wherein said carrying support means includes a strap with the opposite ends thereof mounted on said belt means with one of said ends of said strap being slidably adjustable about said belt means wherein said strap is adjustable relative to said belt means to provide close encirclement of the periphery of separable articles by said strap to support said articles on said belt means.

4. The article of wearing apparel according to claim 1, wherein said carrying support means is adjustable to provide support means for more than one separable article concurrently on said belt means.

5. An article of wearing apparel suitable for carrying more than one separable article of the same or different size which comprises:

belt means having means for securing the same about an individual;

carrying support means having mounting means for mounting the same on said belt means comprising a strap mounted in alignment with said belt means at opposing ends of said strap, one of said opposing ends being slidably mounted to said belt means with the strap between the opposing ends being adjustable relative to said belt means for encircling articles of different sizes to support the same on said belt means, wherein a wearer's hands would be free to perform other activities, and said carrying support means further comprising bottom support means attached to said strap for providing additional support to the bottom of said articles.

6. The article of wearing apparel according to claim 5, wherein said carrying support means comprises a strap mounted in alignment with the longitudinal axis of said belt means at a central portion and opposing ends of said strap, at least the opposing ends of said strap being slidably mounted on said belt means with the strap between the portions of said strap between the portions thereof mounted on said belt means being adjustable relative to said belt means for separately encircling container-like articles of different sizes to support the same on said belt means.

7. The article of wearing apparel according to claim 6, wherein said carrying support means includes means for concurrently supporting more than one container of the same or different size on said belt means.

* * * * *